United States Patent [19]

Elton et al.

[11] Patent Number: 4,622,116

[45] Date of Patent: Nov. 11, 1986

[54] PROCESS FOR ELECTRODEPOSITING MICA ON COIL OR BAR CONNECTIONS AND RESULTING PRODUCTS

[75] Inventors: Richard K. Elton, Altamont; William R. Schultz, Jr., Schenectady, both of N.Y.

[73] Assignee: General Electric Company, Schenectady, N.Y.

[21] Appl. No.: 752,418

[22] Filed: Jul. 5, 1985

Related U.S. Application Data

[63] Continuation-in-part of Ser. No. 702,525, Feb. 19, 1985, which is a continuation-in-part of Ser. No. 555,058, Nov. 25, 1983, abandoned.

[51] Int. Cl.[4] ..... C25D 13/16; C25D 13/12

[52] U.S. Cl. ..... 204/181.1; 204/181.6

[58] Field of Search ..... 204/181.1, 181.5, 181.6; 524/441, 601, 901, 449, 556, 612; 428/363, 454; 523/401, 402, 440

[56] References Cited

U.S. PATENT DOCUMENTS

| | | | |
|---|---|---|---|
| 2,478,322 | 8/1949 | Robinson et al. | 204/181.1 |
| 2,743,309 | 4/1976 | Lindsay et al. | 524/449 |
| 3,702,813 | 11/1972 | Tanaka et al. | 204/181.1 |
| 4,058,444 | 11/1977 | Shibayama et al. | 204/181.1 |
| 4,533,694 | 8/1985 | Elton et al. | 524/449 |

FOREIGN PATENT DOCUMENTS

| | | |
|---|---|---|
| 52-33084 | 12/1977 | Japan . |
| 53-142442 | 12/1978 | Japan . |
| 55-02047 | 1/1980 | Japan . |
| 57-131267 | 8/1982 | Japan . |

*Primary Examiner*—John F. Niebling
*Assistant Examiner*—B. J. Boggs, Jr.
*Attorney, Agent, or Firm*—Jerome C. Squillaro

[57] ABSTRACT

A process for electrodepositing mica and a water soluble anionic resin binder, such as a modified polyester resin, is disclosed as a means for applying a heavy coating of a high-voltage, mica-bearing electrical insulation onto uninsulated and porous mica tape-insulated portions of electrical connections in dynamoelectric machines. The electrodeposited mica coating is subsequently impregnated with a suitable resin, such as an epoxy or polyester resin, concurrently with the impregnation of other conventional insulations in the machine. Alternatively, deposition and impregnation of the connection insulation can be performed prior to installing the connection into the machine.

4 Claims, 6 Drawing Figures

30
35
40
41
36
42
37

PROCESS FOR ELECTRODEPOSITING MICA ON COIL OR BAR CONNECTIONS AND RESULTING PRODUCTS

This application is a continuation-in-part of U.S. patent application Ser. No. 702,525 filed Feb. 19, 1985, which is a continuation-in-part of U.S. patent application Ser. No. 555,058 filed Nov. 25, 1983, now abandoned.

FIELD OF THE INVENTION

The present invention relates generally to the art of electrophoretic deposition, and is more particularly concerned with a novel process for electrodepositing micaceous insulating coatings on end connections for electrical conductors, especially end connections for electrical coils and the like, and with the resulting novel insulated articles and assemblies.

CROSS REFERENCE This invention is related to that of U.S. Pat. No. 4,533,694, entitled Formulation For Electrodeposition of Mica, to Richard K. Elton and William R. Schultz, Jr. and assigned to the assignee hereof, which discloses and claims a novel mica-containing composition having special utility in providing insulating coatings on electrical conductors.

DEFINITIONS

As used herein and in the appended claims, the term "porous mica tape" means, refers to and includes mica-bearing flexible sheet and tape materials consisting of glass cloth or other suitable fabric or paper to which mica particles are bonded, and which are wettable by the aqueous electrodeposition formulation disclosed and claimed in the above-referenced U.S. Pat. No. 4,533,694, unlike film-covered or film-backed mica or mica-glass sheets and tapes.

"Wettable" in the present context means and refers to the condition permitting penetration of the aqueous solution of the aforesaid formulation into and through the mica-bearing fabric or paper.

BACKGROUND OF THE INVENTION

The connections in dynamoelectric machines are typified by the lengths of bare copper wires which join the stator coils in electric motors to each other and to external motor terminals. Insulation of those small connections is usually accomplished by application of micaceous insulating tape after the connections are made from a few strands of wire and fastened together, for example, by brazing. Because in many cases, the actual connection is only several inches long, has an irregular geometry, and is located in crowded part of the machine, the insulation normally has to be applied manually, a very slow and laborious process.

In larger machines, such as hydroelectric or steam turbine-generators, connections are often made using large copper tubes or bars. These connecting parts may be taped and impregnated prior to installation. In any case, however, because of the irregular shapes involved, much or all of the work must be done by hand.

A less complicated, yet effective technique of applying micaceous insulation, without the need for taping, would be of great benefit in the manufacture of dynamoelectric equipment. In addition to savings in labor and time, the cost of materials could be substantially reduced because insulating tape production involving mica paper fabrication, lamination, etc., would be avoided. Also, less expensive wet ground mica might be used instead of the fluid-split or calcined mica required for tape manufacture.

Heretofore, electrodeposition of mica has been a recognized means of providing an electrical insulation coating or covering. Thus, Shibayama et al, U.S. Pat. No. 4,058,444 discloses such a process for providing insulation for coils of rotary machines, mica and a water dispersion varnish being used in a coating bath formulation. Other patents describe the electrophoretic deposition of mica with the use of water dispersion resins in similar manner to bind the deposited mica particles. Japanese patents issued to Mitsubishi Electric Corp. (Japanese Pat. Nos. 77 126438; 81 05,868 and 81 05,867) are directed along this same line, but none of them disclose the in situ electrodeposition of mica on electrical connections.

German Pat. No. 1,018,088 issued to H. W. Rotter describes the use of electrodeposited mica for insulating electrical connections, and sets forth a coating bath formulation which contains extremely finely divided mica (1 micron). In addition, the possibility of using a silicone resin emulsion to aid in binding the flakes of mica together is mentioned.

Other applications of electrodeposited mica appear in the patent literature which involve the use of a binder either in the form of a water dispersion polymer or an aqueous emulsion. Objects to be coated such as wires, plates, and perforated plates are mentioned.

None of these prior art procedures have proven to be satisfactory enough to displace the manual technique with all of its drawbacks. For one reason, the resultant coating compositions are unable to withstand conditions of the manufacturing environment, coalescing or coagulating when agitated or allowed to stand for prolonged periods. Additionally, the emulsions and dispersions used heretofore result in coatings which are not of uniform thickness, particularly on irregularly shaped conductor substrates because the different levels of electrical field strengths cause corresponding variations in insulating coating thickness.

The generally recognized, long-standing demand for answers to these problems, having not been met through any of the concepts disclosed in the foregoing patents or elsewhere in the patent art, has persisted to the present time.

SUMMARY OF THE INVENTION

By virtue of the present invention which is predicated upon the discoveries and concepts set out below, the shortcomings of the prior art can be avoided and new results and advantages can be obtained. Further, these gains can be made and realized without penalty of offsetting disadvantages of economy or efficiency of production, or of product quality, utility or value.

A key concept underlying this invention, as well as the invention of U.S. Pat. No. 5,33,694, is to use in producing by electrodeposition thick (greater than 50 mils) insulation coatings, a formulation in which the binder is contained in solution rather than being dispersed or emulsified in the liquid vehicle of the deposition formulation.

When such a solution is employed instead of a dispersion or emulsion of the prior art, the problem of thick and thin spots in the electrodeposited mica coatings is minimized as coatings of substantially more uniform thickness are consistently produced. Apparently, this is the result of self-limiting effect arising from the fact that depositions on a conductor from a coating bath containing mica and a water soluble binder result in the conductor becoming increasingly passivated which in turn results in decay of the deposition rate exponentially with time. The decay constant of this system, which determines how rapidly this effect develops, can be controlled by varying the concentration of water soluble binder and/or electrolyte in the coating bath. Thus, the high field strength areas of the conductor will begin to accumulate a heavier coating than the low field regions, but will also more quickly become passivated. The low field strength regions do not become passivated as quickly and, consequently, will continue to acquire a coating at an increasingly greater relative rate than the higher field strength regions. More uniform coating thickness is the result.

It has been further found that coating quality can be enhanced and coating deposition rate can be controlled by adding a relatively small amount of an electrolyte to the aqueous coating bath.

As set forth in the aforesaid referenced patent application, the water soluble resin binder must have anionic functionality, that is, only anionic polymers are useful for our purposes and are therefore contemplated by the appended claims. Cationic or nonionic water soluble polymers, unlike anionic-type polymers, are not compatible with mica electrodeposition formulations because they are not attracted to the anode with the mica which in water dispersion acquires a net negative charge.

Water soluble anionic resins having special utility in this invention are polyesters, epoxyesters, acrylics and carboxy-terminated butadiene/acrylonitrile resins. It will be understood, however, that others may be used together with or in place of these, and that typically such a resin has an acid number (indicating carboxy group content) from 20 to 120 and that it is rendered water soluble by reaction with a substituted amine or other suitable base.

Still another concept of the invention is to impregnate the porous, dried, micaceous coating resulting from the electrodeposition from the aqueous mica containing bath. Thus, with the mica flakes being held together as deposited as a coating, and after baking out the entrained water, resin varnish is applied to the coating and the impregnated coating is baked to cure the resin varnish.

A further discovery is that when the process of this invention is carried out on a conductor which is insulated as by tape wrapped over a portion of the conductor length, the uninsulated bare portion and the immediately adjacent part of the conductor are covered with a continuous crack-free coating of electrodeposited insulating material. This discovery led to the novel concept of insulating the series leads of motor coil assemblies by the process of immersing the bare lead portions and adjacent insulated lead portions in an electrodeposition bath and then electrodepositing a coating of insulating material on not only the bare exposed coil connection parts of the assembly, but also on the adjacent insulated parts thereof to provide overlapped insulation at each coil end connection. A related new concept is to apply insulation to other electrical conductor components of dynamoelectric machines such as pole jumpers for hydrogenerators and similar equipment in which high integrity of the insulating cover material is essential over the full length of the conductor component and its connections.

Another important discovery underlying this invention is that any tendency for insulation produced by the present process to fail either initially or after repeated thermal cycling can be substantially diminished or avoided entirely. In particular, breakdowns which may occur in the interface region between the wrapped insulation and the electrodeposited insulation can be substantially prevented by using as wrapping insulation a porous mica tape. Thus instead of using film-covered or film-backed mica tape to cover an electric conductor, porous mica tape is wrapped on the conductor as at least the uppermost tape layer of the insulation wrapping on the region adjacent to the bare portion of the conductor to be provided with an electrodeposited coating.

Briefly stated, then, in its process aspect the present invention generally comprises the sequential steps of immersing bare electrical connections and/or terminals between an end portion of a wire member in coil form or otherwise and another conductor in an aqueous electrodeposition composition containing mica particles, a water soluble anionic resin binder, an electrolyte and a nonionic surfactant; electrodepositing a coating from the bath on the bare electrical connections to provide a micaceous coating which, when dried and baked, is porous and contains sufficient binder to hold the particles together in place on the substrate; next, the porous coating is impregnated with resin varnish; and finally the impregnated coating is heated to an elevated temperature to cure the resin varnish. This process accordingly is a new combination of procedural steps including the new step involving the use of the new composition disclosed and claimed in the above-referenced patent application.

In more specific terms this new process includes the preliminary step of wrapping a portion of the length of the conductor with insulating material in the form of porous mica tape, and immersing the so insulated part of the conductor and the uninsulated adjacent part in the electrodeposition formulation and thereby wetting the porous mica tape, and then electro-depositing a coating of insulating material from the said formulation on the bare portion and on the immediately adjacent porous mica tape-covered portion of the conductor to provide a continuous crack-free coating of high integrity and superior resistance to breakdown under thermal aging and cycling.

In its product aspect this invention is in general the article or the assembly resulting from the application of the present novel process to electrical conductors generally and especially to those carrying an insulating cover over part of their lengths. Thus an electric motor assembly of insulated coils connected at their ends in series by coil leads which are in part bare and uninsulated as installed is provided with continuous crack-free insulation on each coil lead which overlaps and is bonded securely to porous mica tape insulation on the coil lead as well as to the exposed metal surface thereof.

BRIEF DESCRIPTION OF THE DRAWINGS

Those skilled in the art will gain a further and better understanding of this invention from the following detailed description of it, taken in conjunction with the drawings accompanying and forming a part of this specification, in which FIG. 1 comprises two longitudinal sectional views, FIGS. 1*a* and 1*b* of electrical conductors wrapped with non-porous mica tape (FIG. 1*a*) and porous mica tape (FIG. 1*b*) and covered with electrodeposited insulation by the method of this invention, the novel insulation overlap feature being readily apparent as is the difference between the contact angles of electrodeposited insulation and the two different mica tapes.

DETAILED DESCRIPTION OF THE INVENTION

Figure 1A:
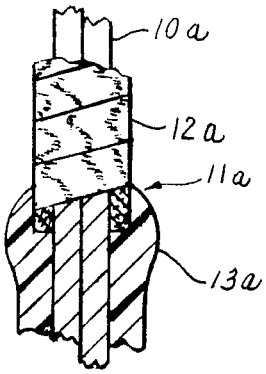

As illustrated in FIG. 1*a*, a conductor in the form of a copper bar 1O*a* is provided with continuous, crack-free insulating cover 11*a* consisting of a combination of non-porous mica tape 12*a* wrapped on conductor 1O*a* over a part of its length and electrodeposited mica insulation coating 13*a* covering and bonded directly to the unwrapped, bare part of the conductor. As an important consequence of electrodepositing insulation coating 13*a* in strict compliance with the process of this invention as described above, the interface between the taped and bare parts of conductor lO*a* is covered by coating 13*a*. Thus the coating overlaps tape 12*a*, extending approximately as far beyond the said interface as the thickness dimension of coating 13*a* on the bar part of the conductor. As shown, coating 13*a* is of substantially uniform thickness over the bare metal but tapers from the interface to a contact angle about 45° at the end over tape 12*a*. Further, as indicated elsewhere herein, the thickness of coating 13*a* is largely a matter of the operator's choice as this invention enables electrodeposition of coatings of high integrity and uniformity of thickness 50 to 150 mils or more.

Figure 1B:
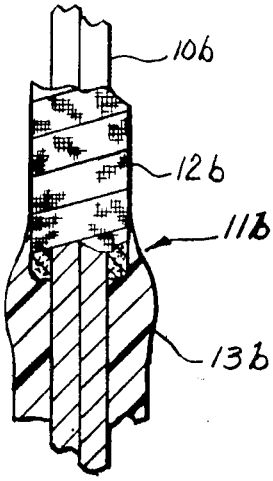

As shown in FIG. 1*b* a conductor 1O*b* like that of FIG. 1*a* has insulation consisting of porous mica tape 12*b* wrapped on the conductor and electrodeposited mica insulation coating 13*b* bonded directly to the conductor and overlapping mica tape 12*b*. This overlap resembles that of FIG. 1*a* but differs therefrom in that the tape-electrodeposited coating contact angle is substantially smaller, being less than about 30°. This difference is entirely to the fact that the porous mica tape is wettable by the electrocoating formulation, while the non-porous tape is not. In addition the open pores of the porous tape allows mechanical interlocking of the two insulating materials. This is not possible with the non-porous tape of FIG. 1*a* the smooth surface of which presents a barrier to such mechanical interlocking effect.

Figure 2:
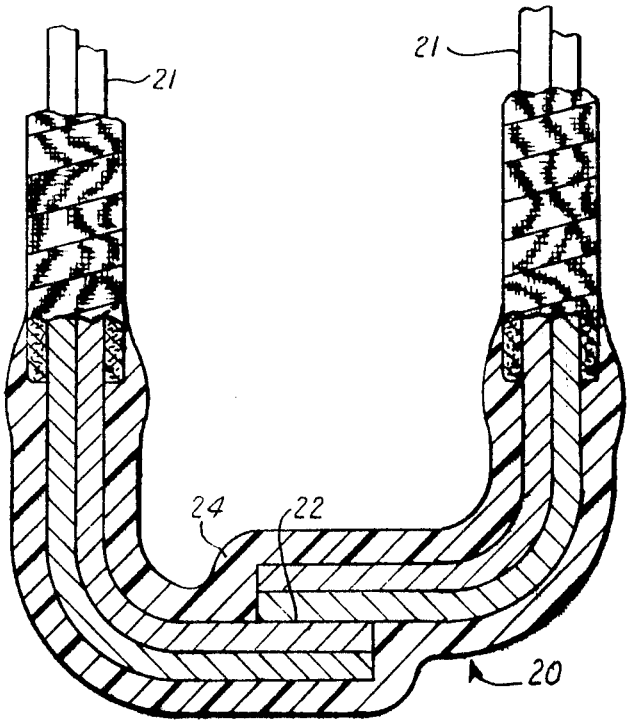
FIG. 2 is a view like that of FIG. 1 of an electric motor series connection the lead portions of which are wrapped with porous mica tape while the central or junction portion is covered by electrodeposited insulation which overlaps and is securely bonded to the porous mica tape.

In the case of series connection 20 of FIG. 2, the lead portion 21 is wrapped with porous mica tape insulation and the central or junction portion 22 is covered with a coating 24 of electrodeposited mica insulation. Again the insulation over the full length of connection 20 is continuous and crack-free because coating 24 bridges over the interface region between wrapped and bare parts of the series connection and is securely bonded to both. In this instance the overlap is approximately 100 mils which is the thickness of coating 24 on the unwrapped or bare part of the element.

Figure 3:
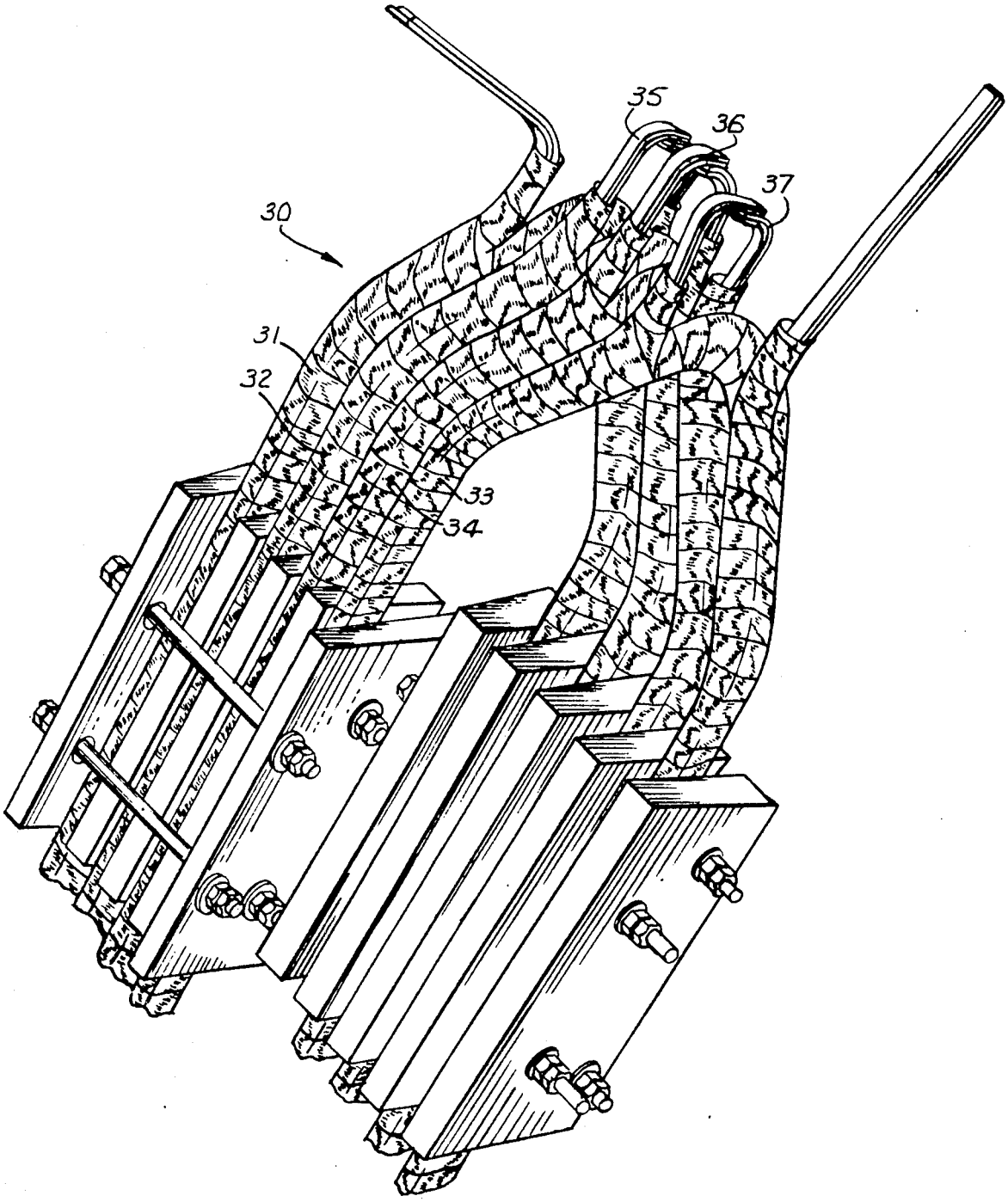
FIG. 3 is a view in perspective of a four-coil formette of an electric motor stator with the coils and portions of the leads wrapped with porous mica tape while bound connection portions of the leads are bare.

Coil formette 30 of FIG. 3 comprises four coils 31, 32, 33 and 34 and three series connections 35, 36 and 37. As in the case of series connection 20 of FIG. 2, the leads to these connections are wrapped to some extent with porous mica tape insulation. The junctions of connections 35, 36 and 37 are not wrapped at the stage of assembly illustrated in this view.

Figure 4:
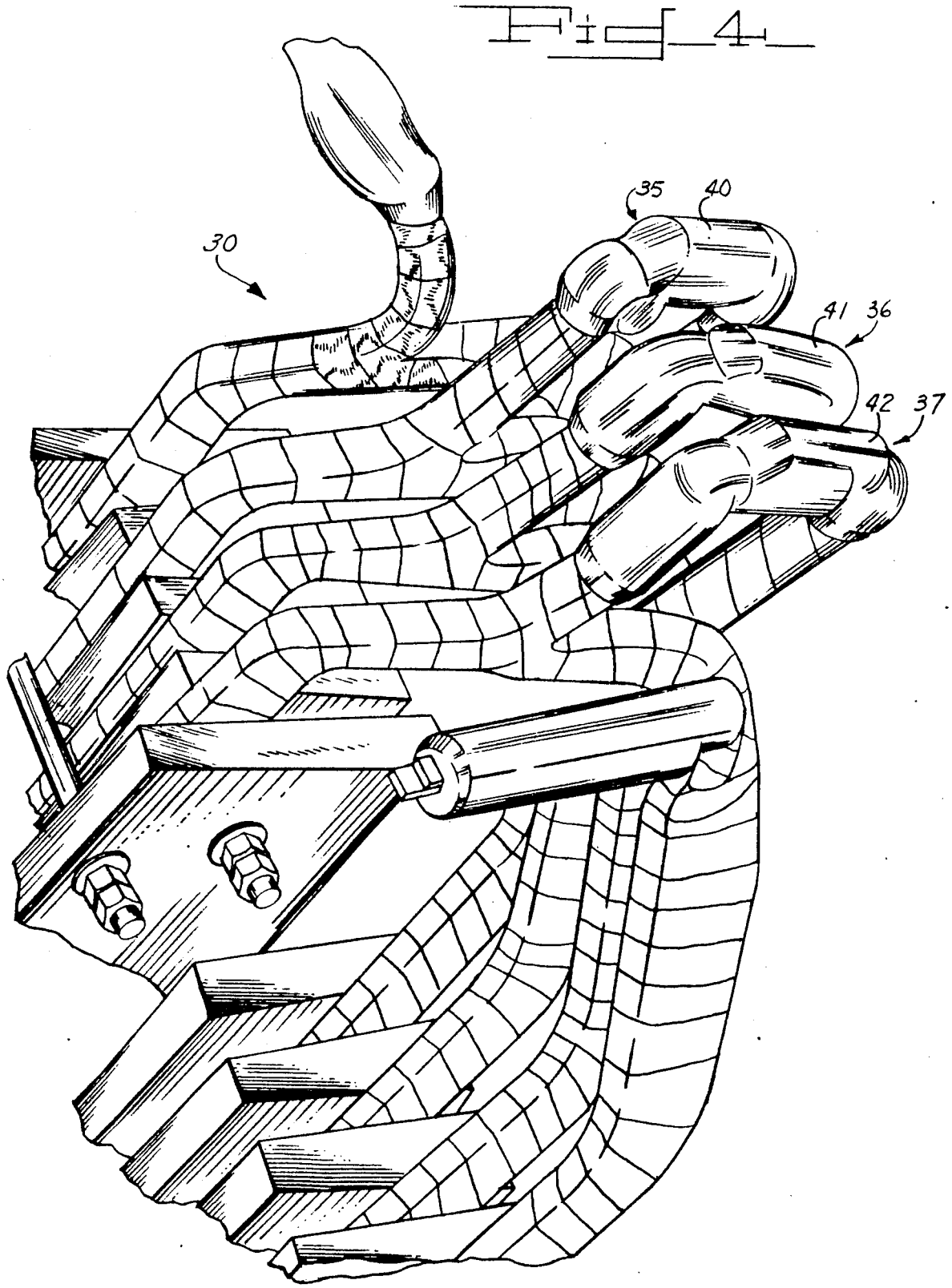
FIG. 4 is a perspective view of the formette of FIG. 3 after insulation has been electrodeposited in accordance with the process of this invention to provide continuous crack-free insultion covering the unwrapped portions and overlapping the porous mica tape-wrapped portions of the coil leads; and, FIG. 5 is a partially diagrammatic sketch of an electrodeposition operation for applying insulating coatings to the bare portions of the series connections of an electric motor stator in accordance with preferred practice of this invention.

Completion of the insulation system of the assembly of FIG. 3 is again accomplished in accordance with preferred practice of the process of this invention with the result shown in FIG. 4. Thus series connections 35, 36 and 37 of formette 30 are insulated by electrodeposited coatings 40, 41 and 42, respectively. Those coatings, like coating 24 on series connection 20, are each of substantially uniform thickness about 100 mils and crack-free and continuous. Further, as a consequence of these coatings being formed as described above by an operation involving dipping of the formette in an electrodeposition bath of the kind specified herein, the ends of each coating have the geometry of coating 13 of FIG. 1, overlying the porous mica tape insulation and bridging across the interface between the taped and untaped parts of the series connection. The relatively low contact angle mentioned above is a consequence of the wetting of the porous mica tape by the electrodeposition formulation.

Figure 5:
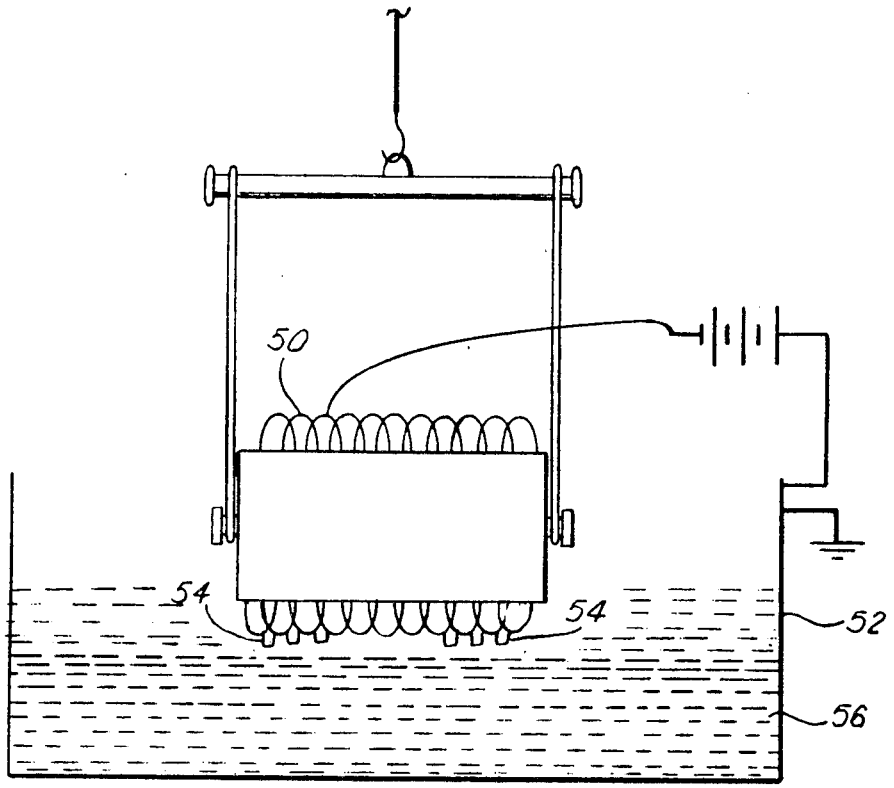

The dipping operation just mentioned is illustrated in FIG. 5 in which an electric motor stator 50 is suspended in coating vessel 52 with series connections 54 of the motor coils immersed in electro-coating solution bath 56. The depth of this immersion is sufficient to insure that the porous mica tape insulation on the series connections is submerged to at least the extent of the overlap of electrodeposited insulation that is desired, then D.C. potential is applied to the system with vessel 52 serving as the ground and the power source suitably being a D.C. generator.

The compositional range of the electrodeposition bath in accord with the invention in weight percent is summarized below:

| Component | Broad Range | Preferred Range |
|---|---|---|
| Mica | 5–35% | 10–16% |
| Soluble Resin Binder (as solids) | 0.2–2% | 0.5–1.5% |
| Electrolyte | 0.001–0.20% | 0.002–0.05% |
| Nonionic Surfactant | 0–0.3% | 0.03–0.10% |
| Water | Balance | Balance |

Mica types and particle sizes useful in the process of this invention include those specified in the above-referenced patent application. Likewise, soluble resin binders, electrolytes and polar solvents useful in this process include those set forth in that patent application. Accordingly, those portions of the specification of said above-referenced application describing those constituents of electrodeposition both useful in the present process are hereby incorporated herein by reference.

The electrical connection or group of connections to be insulated are coated by electrodeposition. The connection is immersed in the aforementioned bath. A direct current (D.C.) potential is applied to the conductor in the connection, typically in the range of +20 to +150 volts. Simultaneously, a grounded counterelectrode must be present in the bath. The mica flakelets in suspension are attracted to the anodic connection and are deposited there as long as current flows from it. The organic binder also codeposits with the mica flakes. Typical deposition times range from 20 to 500 seconds, depending on the binder, electrolyte concentrations and the thickness of the insulation coating desired.

The interface between the electrodeposited mica and the taped insulation is the region of greatest difficulty in achieving a consolidated, crack-free insulation, due to the properties of the two dissimilar insulation materials. In some instances depending on the type of mica tape used, better adhesion, between the electrodeposited mica and the tape, can be accomplished when a nonionic surfactant, i.e., one that does not undergo migration in an electric field, is incorporated into the deposition bath. A typical nonionic surfactant is Tergitol NPX (alkyl phenyl ether of polypropylene glycol), available from Union Carbide Corporation. Beyond this, as indicated above, there is an important advantage to be gained through the use of porous mica tape, at least as the uppermost layer of taped or wrapped insulation. Thus as a consequence of the penetration of the electrodeposition formulation into and through the porous mica tape, an essentially integral connection is created between the tape and the electrodeposited coating as the impregnating resin of the insulation is cured. The bond formed thereby between those two components of the insulation system withstands thermal aging and cycling without failure, which may in part be due to close matching of thermal expansion coefficients resulting from similarities in composition and improved bonding between the two different insulating materials. Furthermore, mechanical interlocking of the electrodeposited mica into the pores of the porous mica tape promotes greater adhesion than with smooth non-porous tapes where such interlocking is not possible.

Porous mica tapes as defined above are exemplified by commercially-available products marketed by Okabe Company (Prepreg Mica Tape DG-864C) and American-Statomat-Micafil, Inc. (Romicaglas 259.40.160). The latter is specially preferred in present practice of this invention because of its low binder content, which approximates 4.5%. While somewhat greater binder contents as upwards of 10% and 20% are tolerable, tapes containing less than about 6% are preferable because of the ease with which they can be wetted by an electrodeposition bath to afford the new results and advantages of this invention.

It is also preferable in the practice of this invention, as indicated above, to use only porous mica tape as wrapping insulation. It is contemplated, however, that nonporous (i.e. film-backed or film-covered) tape can be used as underlayers of wrapping on a conductor with one or more overlayers being of porous mica tape so that good bonding in the interface region between the wrapped and the electrodeposited coating is created.

When enough mica has been deposited, the D.C. current is switched off and the connection is removed from the bath. The initial wet coating on the connection is a composite of mica flakelets, binder solids and water. This coating is allowed to dry at a temperature greater than 0° C. and less than 100° C., but preferably from about 25° C. to about 75° C. The residual water is baked out in an oven at an elevated temperature. At the same time the elevated temperature serves to cure the binder. The result is a dry, micaceous coating which is porous and contains enough binder to hold the mica flakes together.

The next step is a post-impregnation treatment of the porous coating, in which the connection is either dipped into an impregnating varnish or, more preferably, treated by vacuum-pressure impregnation with a suitable epoxy or polyester resin. This impregnation treatment can, in many instances, be part of the same cycle whereby other conventional insulations in the dynamoelectric machine are also being resin treated. Frequently in the actual dynamoelectric machine there are two such post impregnation treatments.

The final step consists of an elevated temperature bake to cure the impregnated resin. Generally, the curing step includes heating to a temperature of 150° to 180° C. for a time of four to six hours. Longer curing times can be used, but are usually not necessary. The higher the temperature the shorter the time required for a satisfactory cure. A typical curing step is at a temperature of 160° C. for a time of six hours.

The resulting product is a micaceous connection insulation, consolidated and void-free. This procedure has the advantages of using low-cost mica and eliminating a difficult taping operation in the connection region.

The invention is further described by Examples I–XV of above identified patent application Ser. No. 702,525 which are incorporated herein by reference, and by the following examples in which all mesh is given in U.S. Standard sieve sizes:

EXAMPLE XVI

Motor series connection models were fabricated by applying insulating tape to both ends of a 13" length of rectangular copper wire (0.075"×0.375" cross section). Four half lapped tape layers were applied along a 4" length of wire on one end and along a 6" length of wire on the other end, leaving the middle 3" of wire bare. The model was then bent into the shape of a "Y" by doubling the bare portion and 1½" of taped portion back on itself to produce a trunk on the Y 3" long.

An electrodeposition bath was prepared by mixing the following ingredients in a 5 gallon vessel:

- 4 lb 325 Mesh Muscovite Mica
- 880 g Acrysol WS-68 water soluble acrylic resin (38% solids)
- 340 g Aquanel 513 water soluble polyester resin (33% solids)
- 8 g Tergitol NP1O nonionic surfactant
- 4 g Sodium Lauryl Sulfate
- 10 g Dimethylethanol amine
- 10 g Ammonium nitrate and
- enough water to bring the volume to 4 gallons.

The connection models were coated with mica by immersing them in this bath and applying a positive potential of 90 volts D.C. for 6 minutes, using the metallic vessel as the cathode. After electrodeposition, the model was removed, dried overnight at 25° C., and baked 6 hours at 170° C. to cure the binder present with the mica. The model was then vacuum-pressure impregnated (VPI) with an epoxy resin consisting of about a 60% cycloaliphatic and 40% a liquid Bisphenol-A diglycidyl ether epoxy, as disclosed in Markovitz U.S. Pat. No. 3,812,214. The model was then baked 6 hours at 160° C. to cure the VPI resin, and thus producing a hard, essentially void-free insulation.

The integrity of the insulation on these models, especially at the interface between the taped and electrodeposited insulations, was tested as follows. The models were aged at 230° C. for 7 days. After aging, they were cooled to 25° C., then immersed in water containing a wetting agent. A potential of 4,600 volts rms at 60 Hz was applied between the copper and the water. Any failures in the insulation were immediately apparent by current flowing.

Three models were thus produced using a film-backed mica insulating tape (General Electric Company non-woven tape product 77956), and 15 models with a porous mica tape (Cogebi product 609.16). All three film-backed models exhibited insulation failures at the taped/electrodeposited interface after the first 7 days of heat aging. The 15 porous tape samples were tested after 7, 17, 21, 25 and 29 days of heat aging. All 15 samples exhibited no failures at this interface, even after 29 days of aging.

EXAMPLE XVII

Models for assessing the integrity of insulation containing both taped and electrodeposited components were prepared using a single 6 ½" length of rectangular copper wire (0.075"×0.375" cross section). Four half-lapped layers of taped insulation were applied from one end along 4 ½" of wire length, leaving the last 2" of copper bare. Five models were made with film-backed mica insulation, five with Okabe DG-864C porous mica tape, and five with Romica 259 porous tape.

An electrodeposition bath was prepared as described in Example XVI. The models were electrodeposited with mica by applying a positive potential of 60 volts D.C. for 12 minutes. The coating was air dried overnight at 25° C., then baked for 6 hours at 170° C. It was then vacuum pressure impregnated with resin and baked as described in Example XVI.

This resulted in a hard, essentially void free insulation, about 0.150" thick in the electrodeposited mica region, and 0.140" thick in the taped region. The models were tested for integrity by heat aging at 230° C., cooling to 25° C., submerging in water, and applying 4,600 volts rms at 60 Hz as outlined in Example XVI.

Table IV summarizes the results. Four out of five of the film backed tape models developed interface failures after four days of heat aging. All of the porous tape samples passed the interface test even after 17 days of aging.

TABLE IV

| Type of Tape Used | Number of Models Tested | Cumulative Number of Interface Failures After Aging at 230° C. | | | |
|---|---|---|---|---|---|
| | | 0 Days | 4 Days | 9 Days | 17 days |
| Film Backed Tape 77956 | 5 | 3 | 4 | | |

TABLE IV-continued

| Type of Tape Used | Number of Models Tested | Cumulative Number of Interface Failures After Aging at 230° C. | | | |
|---|---|---|---|---|---|
| | | 0 Days | 4 Days | 9 Days | 17 days |
| Porous Tape DG-864C | 5 | 0 | 0 | 0 | 0 |
| Porous Tape 259.40.160 | 5 | 0 | 0 | 0 | 0 |

In this specification and in the appended claims wherever percentage or proportion is stated, reference is to the weight basis unless otherwise specifically noted.

It will be appreciated that the invention is not limited to the specific details shown in the illustrations, and that various modifications may be made within the ordinary skill in the art without departing from the spirit and scope of the invention.

What is claimed is:

1. A process for providing a continuous insulating covering on an electrical conductor, which process comprises the steps of:

wrapping a portion of the length of the conductor with porous mica tape;

immersing a bare unwrapped portion of the conductor and the adjacent wrapped portion thereof in an aqueous electrodeposition composition consisting essentially of 5–35% of particulated mica, 0.2–2% of a water soluble anionic resin binder as calculated in resin solids, 0.001–0.20% of an electrolyte, up to 0.3% of a non-ionic surfactant and a polar solvent;

electrodepositing said composition on the bare unwrapped portion of the conductor and the adjacent wrapped portion;

forming a continuous dry micaceous coating on the bare unwrapped and adjacent wrapped portions, said coating being porous and containing a sufficient amount of binder to hold mica particles together;

impregnating the porous coating with an impregnative resin varnish; and subjecting the impregnated coating to an elevated temperature bake to cure the resin varnish.

2. The process of claim 1 further including the steps of baking the electrocoating and thereby removing substantially all the moisture therefrom and curing the resin binder prior to impregnating the porous coating with the impregnative resin varnish.

3. The process as in claim 2, wherein the porous mica tape includes less than about 6% binder.

4. The process for insulating a multiple-coil stator of a dynamoelectric machine which includes the steps of wrapping the coils and portions of the coil leads with porous mica tape, joining the coils in series by securing the respective coil leads together in pairs as coil connections, immersing the stator in an aqueous electrodeposition bath so that bare unwrapped portions and adjacent porous mica tape-covered portions of the coil leads are submerged in the bath, and applying an anodic potential and thereby electrodepositing on both the bare portions and the adjacent wrapped portions of the coil leads a coating of substantially uniform thickness greater than about 50 mils, said aqueous bath consisting essentially of 5–35% of particulated mica, 0.2–2% of a water soluble polyester resin binder as calculated in resin solids, 0.001–0.20% of an electrolyte, up to 0.3% of a non-ionic surfactant and the remainder water.

* * * * *